United States Patent [19]

Gosselin

[11] Patent Number: 5,069,714

[45] Date of Patent: Dec. 3, 1991

[54] SEGREGATION-FREE METALLURGICAL POWDER BLENDS USING POLYVINYL PYRROLIDONE BINDER

[75] Inventor: Francis Gosselin, Sorel, Canada

[73] Assignee: Quebec Metal Powders Limited, Tracy, Canada

[21] Appl. No.: 466,664

[22] Filed: Jan. 17, 1990

[51] Int. Cl.[5] ..... B22F 1/00

[52] U.S. Cl. ..... 75/252; 75/255

[58] Field of Search ..... 75/252, 251, 255

[56] References Cited

U.S. PATENT DOCUMENTS 4,578,114 3/1986 Rangaswamy et al. ..... 75/252

4,871,497 10/1989 Natori et al. ..... 246/86

FOREIGN PATENT DOCUMENTS 184205 7/1989 Japan .

07902 10/1988 PCT Int'l Appl. .

1375410 2/1988 U.S.S.R. .

*Primary Examiner*—Deborah Yee

*Attorney, Agent, or Firm*—Fitzpatrick, Cella, Harper & Scinto

[57] ABSTRACT

An improved metallurgical powder composition of a ferrous powder and at least one of an alloying powder, a lubricant or other additive. Lining, dusting and/or segregation of the composition is prevented by use of a polyvinyl pyrrolidone binding agent.

34 Claims, 4 Drawing Sheets

SEGREGATION-FREE METALLURGICAL POWDER BLENDS USING POLYVINYL PYRROLIDONE BINDER

BACKGROUND OF THE INVENTION

1. Field of the Invention

The present invention generally relates to metallurgical powder mixtures of the type comprising ferrous powder as a main constituent, wherein the ferrous powder is admixed with lesser amounts of alloying compounds, powdered lubricants or other additives as secondary components. In particular, the present invention relates to novel segregation-free compositions comprising such metallurgical powder mixtures which further contain polyvinyl pyrrolidone as a binder component in an amount sufficient to prevent dusting, lining or segregation of the powder components.

2. Brief Description of the Background Art

Processes for producing ferrous powders are well-known, as are many applications for these powders, such as powder metallurgy (P/M) part fabrication. For P/M applications, a ferrous powder is injected into a die cavity shaped to a desired configuration and a compact is formed of the material by the application of pressure. The compact is then sintered wherein metallurgical bonds are developed by the influence of heat. When necessary, secondary operations such as sizing, coining, repressing, impregnation, infiltration, heat or steam treatment, machining, joining, plating, etc. are performed on the P/M part.

It is a common practice to blend a lubricant together with the ferrous powder. This reduces friction between the pressed compact and the die walls during compaction which, in turn, lowers the required ejection force which is necessary to remove the compact from the die, lessening tool wear. Occasionally, the sintered materials which result from the P/M process may themselves be undesirable because, for example, the sintered forms may have insufficient parameters of physical "strength", i.e.; rigidity or flexibility, hardness, tensile strength and the like. Thus, it is common to incorporate with the P/M iron powder minor amounts of at least one non-ferrous metal alloy powder to achieve desired physical properties in the final sintered product. Additionally, minor amounts of other additives may be utilized together with the ferrous powder to achieve the desired properties in the sintered product. The lubricants, alloying powders and other additives may be used together and are collectively referred to herein as "secondary powders".

Examples of this technology are found in various U.S. Pat. Nos. such as, for example, 2,888,738 to Taylor; 3,451,809 to Raman, et al.; 4,106,932 to Blachford; and 4,566,905 to Akashi, et al., as well as European patent application publication No. 0,266,936 to Larson, et al. and commonly-assigned U.S. Pat. No. 4,927,461 to Cilogluer, et al.

Although prior art P/M technology has thus been able to provide sintered materials with specific characteristics, and accordingly has been proven both technically and commercially successful, drawbacks still inherently plague the same. Namely, the present inventor has determined that if the P/M blends are to attain their desired performance characteristics, the powder blend must be maintained in a homogeneous admixture. Variations in the powder blend also contribute to inconsistencies in dimensional change. The secondary powders must not be allowed to migrate through the composition to the walls of the container holding the composition ("lining"), especially those secondary powders of higher density than the ferrous powder which, as a result of vibration, tend to migrate downwardly to settle on the bottom of the container. Also, the secondary powders which have a lower density than the ferrous powder cannot be permitted to migrate upwardly by air currents when being handled and conveyed ("dusting"). In doing so, the loss of homogeneity ("segregation") of the blend is prevented.

These problems can largely be ameliorated by judicious selection of constituents having appropriate specific gravities (see U.S. Pat. No. 4,504,441 to Kuyper). However, the physical properties of the secondary powders are generally of only secondary consideration to the primary goal of obtaining acceptable physical and metallurgical properties in the sintered end product. Therefore, overcoming dusting problems and the like by selecting powders with the goal only of obtaining specific densities has not proven to be highly successful.

Moreover, it is seen that dusting, lining or segregation problems are also exacerbated when the primary and secondary powders which are utilized in the composition are of significantly different sizes. However, those skilled in the art recognize that it is often necessary to utilize secondary powders of disparate size to the primary powders in order to resolve the conflicting requirements that (i) no primary powder particle be located further from a secondary powder particle than a predetermined number of primary particles and (ii) only a maximum amount of the secondary powders may be utilized in the powder blend (lest other physical properties of the sintered product be affected). That is, it is only possible to provide a sufficiently large number of secondary powder particles without increasing the weight amount of the secondary powder material by reducing the size of secondary powder particles.

However, reducing the secondary powder particle size may result in lining, dusting or segregation because the smaller secondary powder particles are physically excluded by the larger primary powder particles. Additionally, many secondary powders also have chemical characteristics or physical characteristics, such as shape, which encourage their segregation from the composition or indeed, even their aggregation. This is recognized, for example, in U.S. Pat. No. 4,676,831 to Engstrom which discusses the use of prealloyed powders. However, these prealloyed powders still fail to solve the problem of incorporating additional nonalloying materials such as the lubricants discussed above, or materials such as graphite.

A desirably homogeneous admixture of primary and secondary powders can be usually attained when the composition is first blended. Unfortunately, however, handling and conveying the blends leads to segregation of previously well-blended compositions.

One solution to these problems is to incorporate in the composition a third component to bind the secondary particles to the primary particles. Suitable binder components include sticky or viscous liquids such as oils, emulsions and the like (U.S. Pat. No. 4,676,831 to Engstrom). However, use of these materials is somewhat diminished because they tend to both make the powder composition agglomerate and inhibit its flowability.

Dry binder components have also been utilized, such as polyvinyl alcohol, polyethylene glycol, polyvinyl acetate (U.S. Pat. Nos. 3,846,126; 3,988,524 and 4,062,678 to Dreyer, et al., U.S. Pat. No. 4,834,800 to Semel).

Generally, thin liquid binders are homogeneously blended into the compositions and dried, while the viscous or powdery binders may be either blended dry (with dry or prewetted compositions), or dissolved in a carrier. Most commonly, however, viscous or sticky liquids are desirably dissolved in solvents to encourage homogeneous blending. Additionally, since it can be difficult to effectively blend dry binding components, they are usually first dissolved in solvent, dispersed throughout the powder blend, whereupon the solvent is evaporated.

Although solid and viscous binders can be dispersed when they are dissolved in solution, competing problems of making the solution thin enough to disperse well versus minimizing the amount of diluent used (since it later needs to be evaporated) provides that only a relatively narrow range of solution concentration is desired. Inasmuch as it may be difficult to determine the optimal amount of solvent, it has been known (see U.S. Pat. No. 4,504,441 to Kuyper) to mix a quantity of liquid furfuryl alcohol into a powder composition and then blend in an acid to polymerize and solidify the furfuryl alcohol. However, the present inventor has determined that the use of solid binders, such as Kuyper's polymerized compound increases the compacting pressure which is needed to densify the metallurgical blends.

It is also said that the use of water-soluble binders is disadvantageous since they may be difficult to dry, absorb moisture and encourage rust. Therefore, those of ordinary skill in the art prefer to utilize polymeric binding agent resins which are water-insoluble or substantially water-insoluble, such as polyvinyl acetate, polymethacrylate, or cellulose, alkyd, polyurethane or polyester resins (U.S. Pat. No. 4,834,800 to Semel).

The present invention addresses and overcomes many of the deficiencies of the prior art by providing a novel metallurgical powder blend comprising a binder of polyvinyl pyrrolidone. These features and others are provided by a metallurgical powder composition comprising ferrous powder having a maximum particle size of at most about 300 microns; and at least one of (i) an alloying powder in the amount of less than about 15 weight percent, (ii) a lubricant in the amount of less than about 5 weight percent and (iii) an additive in the amount of less than about 5 weight percent, said composition further comprising a binding agent for preventing the alloying powder or lubricant from segregating from said composition, said binding agent comprising polyvinyl pyrrolidone.

DETAILED DESCRIPTION OF THE INVENTION

Figure 1:
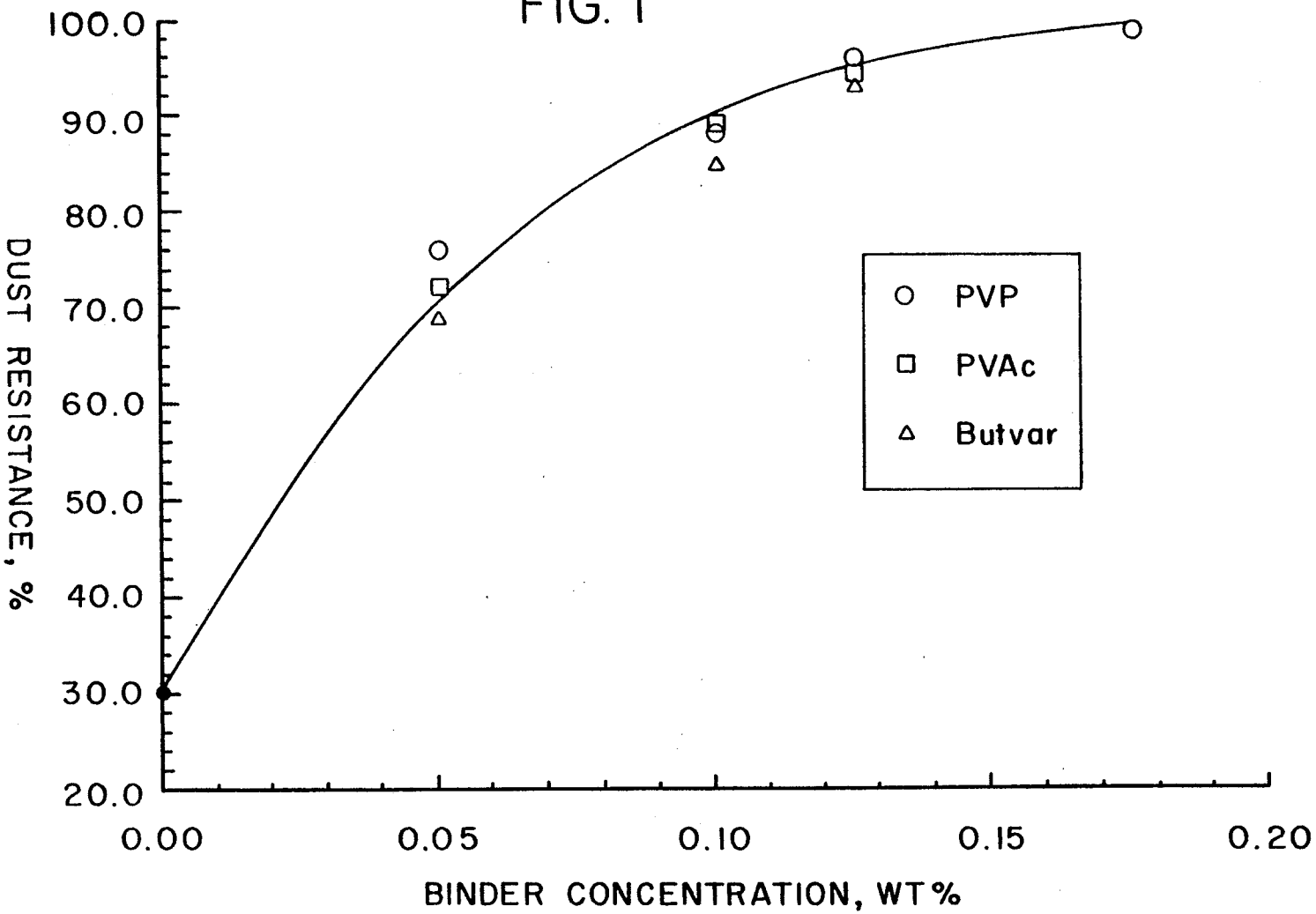
FIG. 1 is a graph representing the effect of binder concentration on dust resistance.

The present inventor conducted detailed studies for manufacturing segregation-free blends in which lining, dusting or segregation are practically eliminated. As utilized herein, the term "segregation-free" is used to characterize a metallurgical blend in which the alloying elements (such as, for example, graphite, copper, nickel and the like), lubricants and other secondary powders are no longer susceptible to lining, dusting or segregation.

The present invention is utilized with ferrous powders, such as steel powder, which is typically made by discharging molten steel metal from a ladle into a tundish where, after passing through refractory nozzles, the molten steel is subjected to atomization by high-pressure water jets. The atomized steel is then dried and subsequently annealed to remove oxygen and carbon. The pure cake which is recovered is then crushed back to a powder.

Essentially any ferrous powder having a maximum particle size less than about 300 microns can be used in the composition of this invention. Typical ferrous powders are steel powders including stainless and alloyed steel powders. Atomet® 1001, 4201 and 4601 steel powders manufactured by Quebec Metal Powders Limited of Tracy, Quebec, Canada are representative of the steel alloyed powders. These Atomet® powders contain in excess of 97 weight percent iron and have an apparent density of 2.85–3.05 g/cm$^3$ and a flow rate of 24–28 seconds per 50 g. Atomet® 1001 steel powder is 99 plus weight percent iron, while steel powders 4201 and 4601 contain 0.6 and 0.55 weight percent molybdenum and 0.45 and 1.8 weight percent nickel, respectively. Virtually any grade of steel powder can be used.

While the binder (polyvinyl pyrrolidone) of this invention was found to be effective using Atomet® steel powder, iron powders can also be used as the ferrous powders for the blends of this invention. These powders have an iron content in excess of 99 weight percent with less than 0.2 weight percent oxygen and 0.1 weight percent carbon. Atomet® iron powders typically have an apparent density of at least 2.50 g/cm$^3$ and a flow rate of less than 30 seconds per 50 g.

The secondary materials contained in this invention include alloying agents such as graphite and other metallurgical carbons, copper, nickel, molybdenum, sulfur or tin, as well as various other suitable metallic materials, the manufacture, use and methods of inclusion of which in ferrous powder blends are extremely well-known in the art. Generally, the total amount of alloying powder present is less than 15% by weight and usually less than 10% by weight. In most applications, less than about 3% by weight of alloying powder will be included in the powder blends of this invention. Most commonly, the maximum particle size of the alloying agent will not be larger than that of the ferrous powder. Desirably, the maximum particle size of the alloying agent will be at most about 150 microns, preferably, at most about 50 microns. Most preferably, the average particle size of the alloying agent will be at most about 20 microns.

Other secondary materials which are commonly incorporated are also well-known to those skilled in the art and include, for instance, lubricants such as zinc stearate, stearic acid, wax, etc. Such lubricants are typically utilized in the blended powders at up to about 5% by weight. Preferably, they are present at less than about 2% by weight and most preferably, at less than about 1% by weight. The lubricant will typically have an average particle diameter of no more than about 100 microns. Desirably, the maximum particle size of the lubricants will be no more than about 100 microns and preferably, no more than about 50 microns. Most preferably, the average particle diameter of the lubricants will be no more than about 25 microns. In this regard, if the lubricant is utilized in the form of agglomerates, the above size limitations refer to the average particle sizes of such agglomerates.

Other additives which may be incorporated are also well-known to those skilled in the art and include, for instance, such secondary materials as talc, manganese sulfide, boron nitride, ferro-phosphorus and the like.

Such additives are typically utilized in the blended powders at up to about 5% by weight. Preferably, they are present at less than about 2% by weight and most preferably, at less than about 1% by weight. The additive will typically have an average particle diameter of no more than about 50 microns. Desirably, the maximum particle size of the additives will be no more than about 50 microns and preferably, no more than about 20 microns. Most preferably, the average particle diameter of the additives will be no more than about 5 microns. In this regard, if the additive is utilized in the form of agglomerates, the above size limitations refer to the average particle sizes of such agglomerates. Various other materials, including other binding agents, which are conventionally known in the art may, of course, also be used.

SPECIFIC EMBODIMENTS

Binders were dissolved in an appropriate solvent and sprayed in the powder mixture as a fine mist. After homogenization in a blender, the mixture is dried by vacuuming and/or evaporating the solvent and recovering the removed solvent by condensation for recycling. Evaporation of the solvent causes product temperature to decrease lowering the evaporation rate and augmenting drying time. By circulating a liquid at a controlled temperature through a jacket of the blender, product temperature can be maintained and drying times can be reduced.

In the tests, Atomet® 1001 steel powder was used as the base powder to which 0.8% South Western 1651 graphite and 0.8% Whitco zinc stearate (ZnSt) were added. The binding agents employed were polyvinyl pyrrolidone (GAF: PVP K15), polyvinyl acetate (Union Carbide: AYAA resin) and polyvinyl butyral (Monsanto: BUTVAR B-74). The binders were dissolved in methanol to a solid concentration of 10 wt. % for application to the blend. Table 1 outlines the test program followed for the study.

TABLE 1

| | INJECTION SYSTEM | | | DRYING CONDITIONS | | | |
|---|---|---|---|---|---|---|---|
| BINDER, % | SPRAY | DISPERSION BAR | POURING | NO HEAT | 38° | 52° | 66° C. |
| PVP | | | | | | | |
| 0.05 | | | X | X | | | |
| 0.10 | | | X | X | | | |
| 0.125 | X | | | | | X | |
| " | X | | | X | | | |
| " | X | | | | X | | |
| " | | X | | X | | | |
| " | | X | | | | X | |
| " | | | X | X | | | |
| 0.175 | X | | | | | | X |
| PVAc | | | | | | | |
| 0.05 | | | X | X | | | |
| 0.10 | | | X | X | | | |
| 0.125 | X | | | | X | | |
| PVBut | | | | | | | |
| 0.05 | | | X | X | | | |
| 0.10 | | | X | X | | | |
| 0.125 | X | | | | | | X |

The efficiency of the binding agents was determined by measuring the resistance of the powder blend to dusting when fluidized by a stream of gas (air, $N_2$, etc.) and by evaluating the flowability of the mix. The effect of binder concentration and the various binder systems on green and sintered properties for the powder blends compacted to a green density of 6.8 g/cm$^3$ was also evaluated.

In the dust resistance test, air is directed at a constant flow rate of 6.0 liters/minute for ten minutes through a 2.5 cm. diameter tube with a 400 mesh screen upon which the test material is placed. This causes the test material to bubble and fine particles (such as graphite) to be entrained as a result of a large surface-to-volume ratio and low specific gravity. The graphite and other similar materials then are deposited in the dust collector.

For the solvent recovery system, total drying time was measured as function of temperature of the heating-/cooling system. This system controls the temperature of the incoming oil that circulates throughout the jacket of the blender making it possible to test the effect of temperature.

Before defining the equipment requirements, tests were performed in order to determine if the sequence of the materials added in the blend has any effect on the quality of the blend. Table 2 shows the sequences studied.

TABLE 2

| SEQUENCE | A | B |
|---|---|---|
| 1 | Steel Powder | Steel Powder |
| 2 | Binder Solution | Lubricant, Graphite |
| 3 | Lubricant, Graphite | Binder Solution |

In "A", the steel powder was sprayed with the binder solution while blending. This continued for five minutes, after which the graphite and lubricant were added. In "B", the lubricant and graphite were added to the steel powder and mixed for five minutes, at which time the binder solution was sprayed in. After step "3", in both "A" and "B", blending continued for 30 minutes with samples taken periodically.

It was evident from observing the samples that sequence "A" produced many undesirable agglomerations of ZnSt and graphite while none was noticed using sequence "B". Nevertheless, once the agglomerates were removed by screening, no apparent differences in physical or metallurgical properties were measured when comparing identical blends fabricated by sequence "A" and "B". Since sequence "B" produced no agglomerations whatsoever, subsequent blends were prepared utilizing that procedure.

With the technique developed for processing segregation-free blends, a considerable amount of liquid has to be mixed into the blend (i.e. approximately 200 liters for a blend of 20 metric tons). Therefore, the method utilized to add the binder solution is an important parameter to consider. Three different methods of liquid addition were studied.

In the first, the binder solution is simply poured in its entirety into the blender through the product inlet. In the second, the binder solution is fed by gravity through a dispersion bar which rotates about the axis of the blender. The third method of liquid addition calls for a specialized pump and nozzle to spray the liquid binder without causing any change in pressure inside the blender.

When the spray system was utilized, the blending time necessary to obtain a homogeneous blend decreased significantly (5–10 min). The very fine mist which can be produced with this system distributes the binder evenly and at no time was there any accumulation of the binder solution in the blend. Although parts of the blend appeared to be slurry-like during the early stages of blending when the dispersion bar or pouring procedures were used, by increasing blending time homogeneous blends were obtained. Dust resistance and flow properties were found to be practically identical with those of the spray procedure once the blends were homogeneous. Nonetheless, the present inventor believes that it is likely that some particles of the blend are overcoated with the dispersion bar and pouring method. Metallurgical properties were also found to be similar from one injection system to the other.

After the blend is completed, the solvent has to be removed or evaporated leaving the admixed elements well embedded in a thin solid film covering the iron particles. This solid tacky-free film is believed to enhance flow properties. If the solvent is not evaporated, the blend will not dry sufficiently on its own. Consequently, the improved flow and dust properties associated with segregation-free blends are not fulfilled. One piece of equipment which is needed to produce segregation-free blends is, therefore, a drying or vacuum system.

The vacuum system is usually coupled with a condensation chamber to recover the solvent. In this recovery system, the gas leaving the blender is saturated with the solvent, which then condenses in the condensation chamber. The solvent can then be recycled, thereby lowering production costs.

The total drying time is greatly dependent on product temperature. Augmenting product temperature increases the evaporation rate which ultimately decreases total drying time and vice-versa. The product temperature can be easily regulated, for example, by circulating a liquid or gas at a controlled temperature through the jacket of the blender.

Drying time was initially recorded for blends without any product temperature control. Extremely long drying times were needed since as soon as the product was put under vacuum the product temperature decreased. As temperature decreased, the evaporation rate was lowered necessitating lengthy drying times up to 1½ hours. Subsequently, the temperature of the liquid circulating through the jacket of the blender was controlled at 38°, 52° and 66° C. With an increase in liquid temperature, the product temperature was maintained higher, thereby decreasing total drying time. For liquid temperatures of 60° C. or greater, product temperature reaches high levels. It is believed that high product temperatures during blending will cause lubricants (wax, ZnSt, stearic acid, etc.) to soften hindering powder properties. The optimum liquid temperature under the particular test conditions was found to be situated around 50° to 55° C. At these temperatures, product temperature was maintained at about 25° C. and the drying time was just less than 0.5 hour.

The effect of the various binding agents on powder properties of the blends are illustrated in FIGS. 1 to 4. For blends free of any binder, dust resistance (FIG. 1) was measured at 30%. The binder, PVP-K15, was tested at four different concentrations, i.e. 0.05, 0.10, 0.125 and 0.175%. At 0.125% binder concentration, dust resistance was about 95% which is excellent. At 0.10% PVP K15 dust resistance was measured at 88%.

Figure 2:
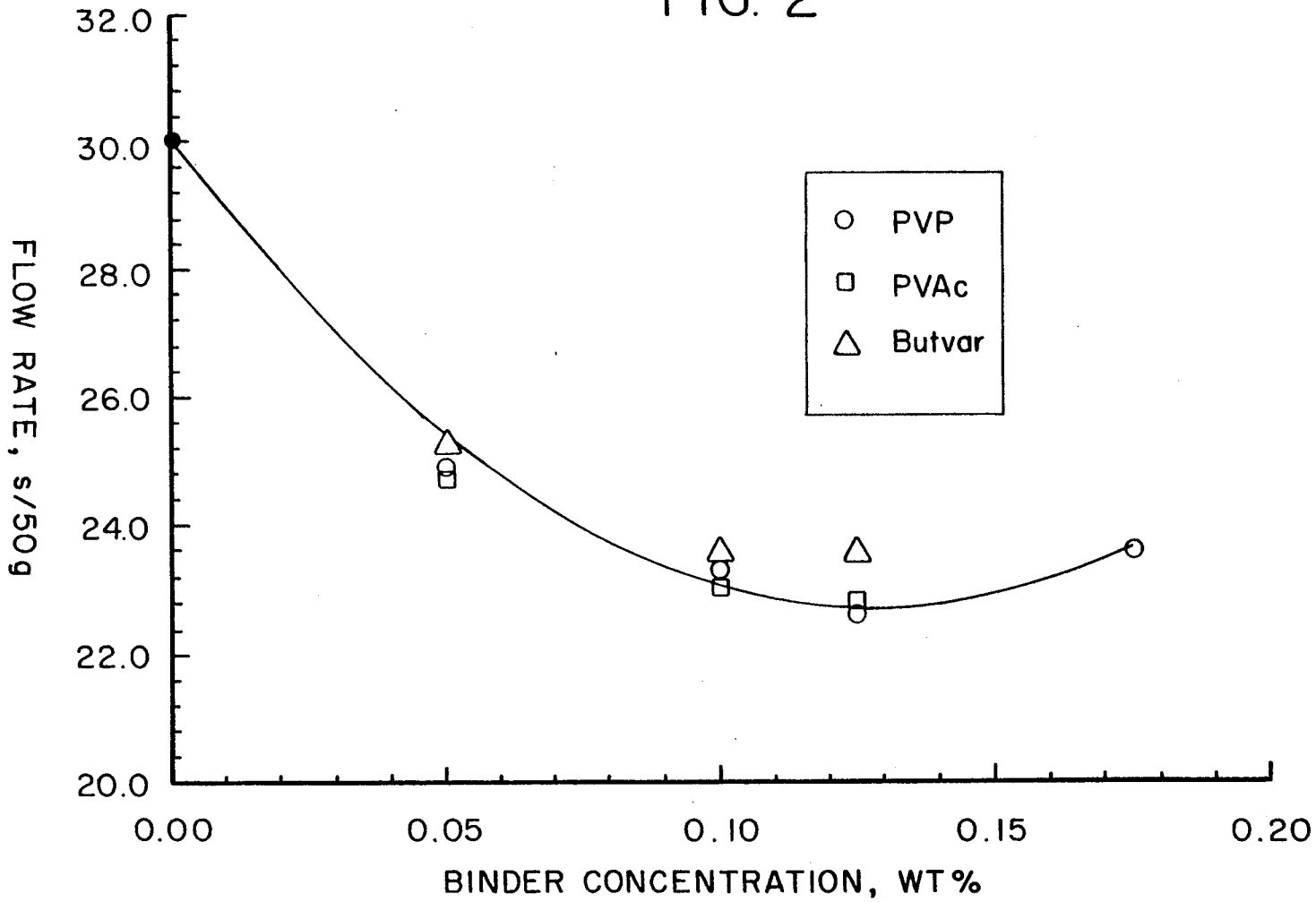
FIG. 2 is a graph representing the effect of binder concentration on flow rate.

FIG. 2 illustrates the improved flow rate obtained with binders. At 0.125% concentration of either PVP or PVAc, flow rate is improved from 30 s/50 g (for a blend without binder) to about 23 s/50 g.

Figure 3:
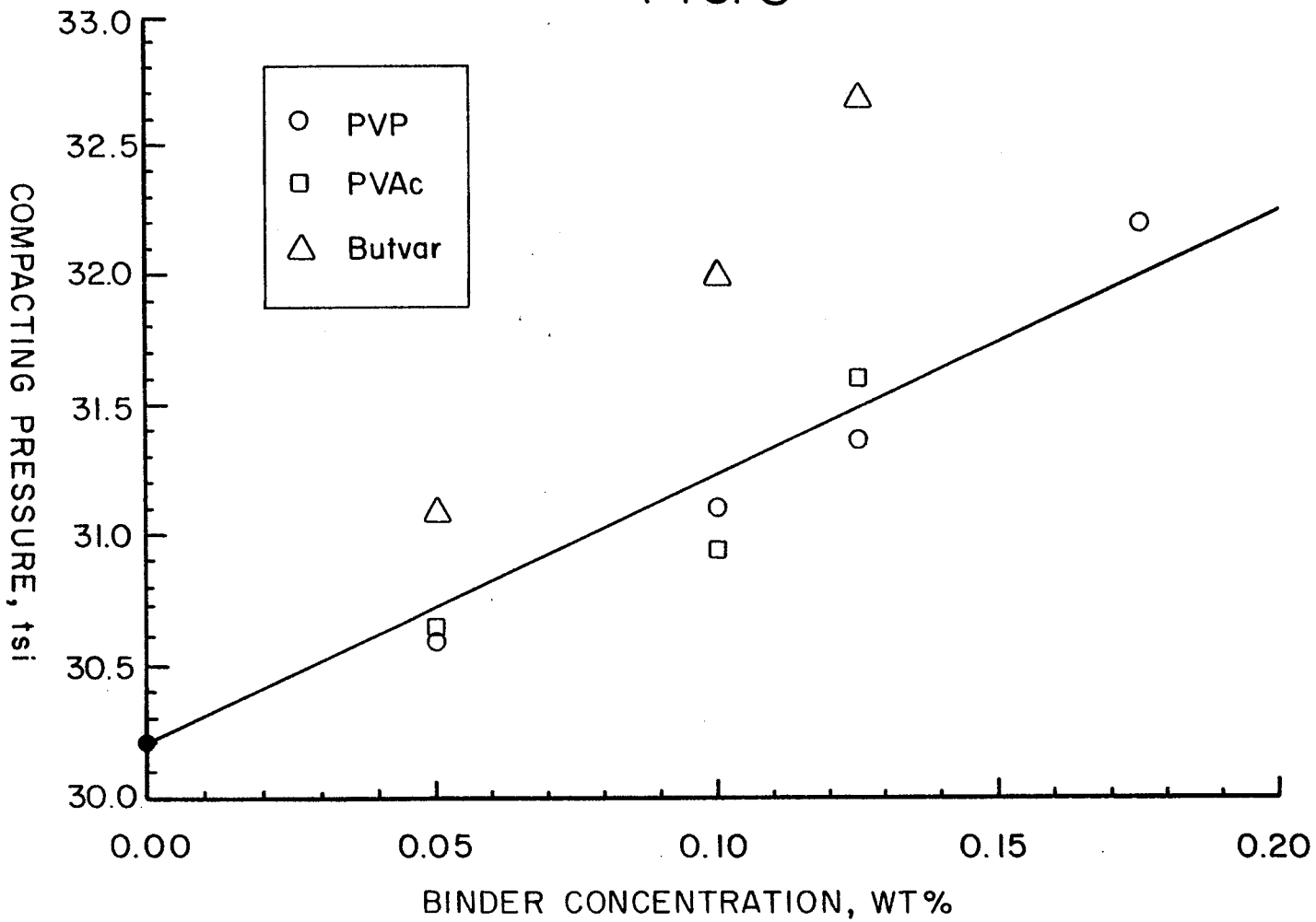
FIG. 3 is a graph representing the effect of binder concentration on compacting pressure.
Figure 4:
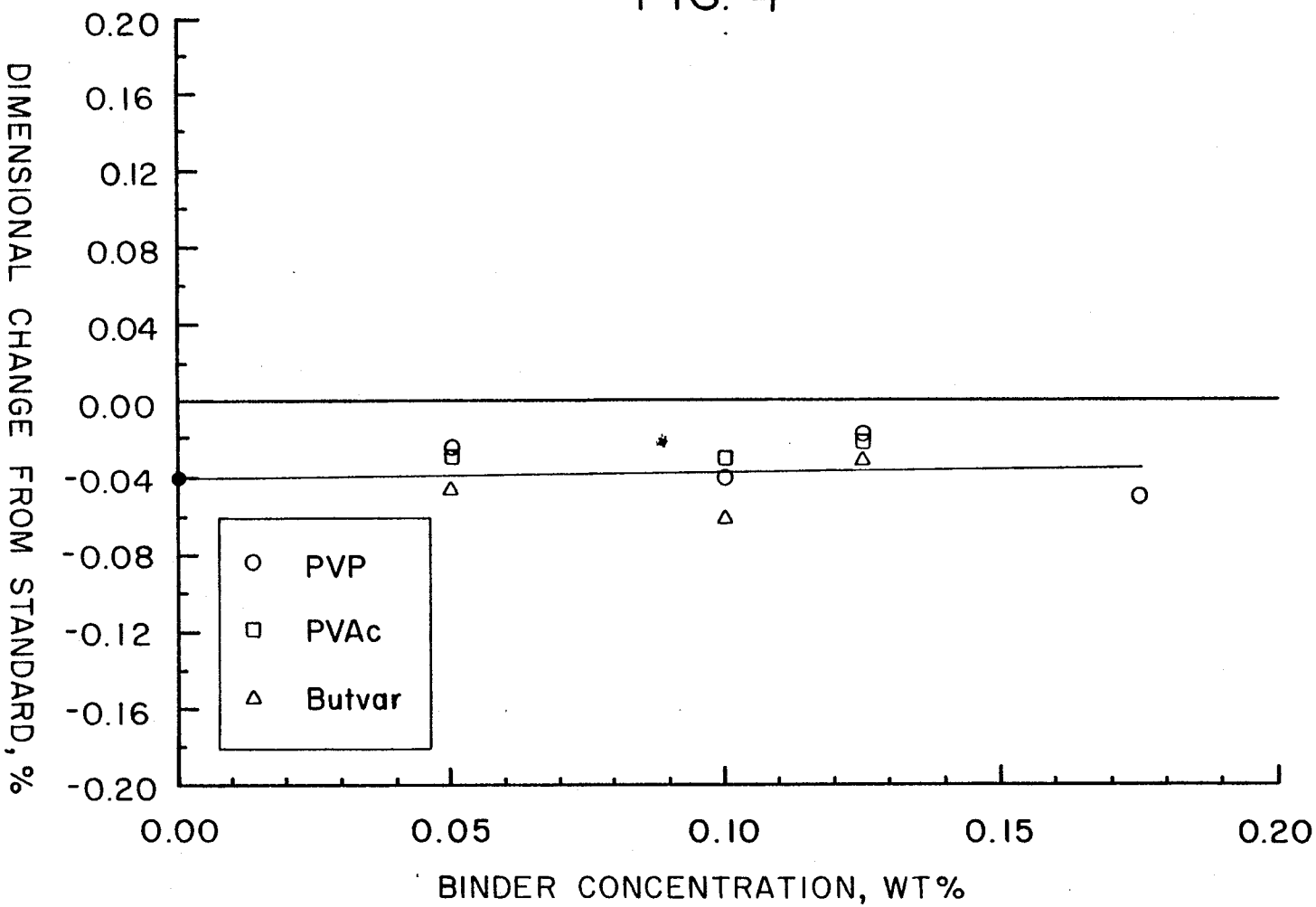
FIG. 4 is a graph representing the effect of binder concentration on dimensional change from the die size.

Green properties of parts made from binder-treated blends were found to be only slightly affected. As seen in FIG. 3, the compacting pressure needed to attain 6.8 $g/cm^3$ green density was increased by about 1 tsi when compared to a regular blend at 0.125% PVP concentration. Butvar, however, has a far more detrimental effect on compressibility. Another way of representing the effect on compressibility is by measuring the green density for the same compacting pressure (ASTM B331-76). At 30 tsi, for a 0.125% concentration of either PVAc or PVP, a decrease of 0.02 to 0.03 $g/cm^3$ was observed when compared to a blend free of binder.

In accordance with the present invention, polyvinyl pyrrolidone is added to the steel powder blend in an amount of at most about 0.2% weight (dry), desirably at about 0.15% weight and preferably at most about 0.1% weight. Generally, more polyvinyl pyrrolidone is utilized when iron powder is used than when steel powder is used. To this end, when iron powders are utilized as the ferrous powder, polyvinyl pyrrolidone is added to the blend in an amount of at most about 0.3% weight (dry), desirably at about 0.25% weight and preferably at most about 0.2% weight. Most preferably, however, no more polyvinyl pyrrolidone is added to the ferrous powder blends than is necessary to ameliorate the tendency of the powder blends to dust and render the composition segregation-free thereby. Although there are no particular limitations on the polyvinyl pyrrolidone binder which is utilized in the present invention, it is preferred that the polyvinyl pyrrolidone is minimally crosslinked in order to enhance its solubility in solvent and its dispersibility in the powder composition. Additionally, although no maximum molecular weights for the polymer are intended, it is desirable that high polymers not be used, since they tend to disclose and disperse slowly. Generally, molecular weights up to 400,000 are usable, with polymers of from 10,000 to 100,000 being preferred.

Additionally, in this invention, it is possible to utilize copolymers of vinyl pyrrolidone. If such a copolymer is selected for use as the binder in accordance with this invention, it is preferred that the co-monomer be selected from monomers such as vinyl acetate and the like. It is further preferred that the vinyl pyrrolidone monomer comprise at least 50% of the copolymer monomer units, and especially preferred that the vinyl pyrrolidone monomer comprise at least 70% of the copolymer monomer units.

Polyvinyl pyrrolidone is highly soluble in many organic solvents such as alcohols, acids, esters, ketones, chlorinated hydrocarbons, amines, glycols, lactams and nitroparaffins. Solubility of the polymer in water is typically limited only by the viscosity of the resulting solution. Generally, any desired solvent may be utilized, with alcohols being preferred and methanol being highly preferred. Ideally, as little solvent is utilized as possible, although 10 percent solutions are commonly applied. The polyvinyl pyrrolidone can, of course, be mixed in dry form with either dry or pre-wetted powder blends, if desired.

It should be understood that various modifications can be made to the preferred embodiments disclosed herein without departing from the spirit and scope of the invention or without the loss of its attendant advantages. Thus, other examples applying the principles described herein are intended to fall within the scope of the invention provided the features stated in any of the following claims or the equivalent of such be employed.

What is claimed is:

1. A metallurgical powder composition capable of forming by a P/M process a compact in a dye cavity, said powder composition being uniformly blended and comprising ferrous powder having a maximum particle size of at most about 300 microns; and at least one powder of (i) an alloying agent in the amount of less than about 15 weight percent, (ii) a lubricant in the amount of less than about 5 weight percent or (iii) an additive in the amount of less than about 5 weight percent, said composition further comprising a binding agent for preventing the alloying powder, lubricant or additive from segregating from said composition, said binding agent comprising polyvinyl pyrrolidone.

2. The metallurgical composition according to claim 1, wherein said alloying powder, lubricant or additive has a maximum particle size of less than said ferrous powder.

3. The metallurgical composition according to claim 2, wherein said ferrous powder is steel powder and said binding agent is present in the amount of less than about 0.2 weight percent.

4. The metallurgical composition according to claim 3, wherein said binding agent is present in the amount of less than about 0.15 weight percent.

5. The metallurgical composition according to claim 4, wherein said binding agent is present in the amount of less than about 0.1 weight percent.

6. The metallurgical composition according to claim 2, wherein said ferrous powder is iron powder and said binding agent is present in the amount of less than about 0.3 weight percent.

7. The metallurgical composition according to claim 6, wherein said binding agent is present in the amount of less than about 0.25 weight percent.

8. The metallurgical composition according to claim 7, wherein said binding agent is present in the amount of less than about 0.2 weight percent.

9. The metallurgical composition according to claims 3 or 6, wherein said alloying powder is present at less than about 10 weight percent.

10. The metallurgical composition according to claims 3, 4, 6 or 7, wherein said alloying powder is present .at less than about 3 weight percent.

11. The metallurgical composition according to claim 9, wherein said alloying powder has a maximum particle size of less than about 150 microns.

12. The metallurgical composition according to claim 11, wherein said alloying powder is present in the amount of less than about 3 weight percent.

13. The metallurgical composition according to claim 10, wherein said alloying powder has a maximum particle size of less than about 50 microns.

14. The metallurgical composition according to claims 5 or 8, wherein said alloying powder is present in the amount of less than about 3 weight percent and has an average particle size of less than about 20 microns.

15. The metallurgical composition according to claims 3 or 6, wherein said lubricant is present at less than about 2 weight percent.

16. The metallurgical composition according to claims 3, 4, 6 or 7, where said lubricant is present at less than about 1 weight percent.

17. The metallurgical composition according to claim 15, wherein said lubricant has a maximum particle size of less than about 100 microns.

18. The metallurgical composition according to claim 16, wherein said lubricant has a maximum particle size of less than about 50 microns.

19. The metallurgical composition according to claims 5 or 8, wherein said lubricant is present at less than about 1 weight percent and has an average particle size of less than about 25 microns.

20. The metallurgical composition according to claims 3 or 6, wherein said additive is present at less than about 2 weight percent.

21. The metallurgical composition according to claims 3, 4, 6 or 7, where said additive is present at less than about 1 weight percent.

22. The metallurgical composition according to claim 21, wherein said additive has an average particle size of less than about 50 microns.

23. The metallurgical composition according to claim 20, wherein said additive has a maximum particle size of less than about 50 microns.

24. The metallurgical composition according to claim 21, wherein said additive has a maximum particle size of less than about 20 microns.

25. The metallurgical composition according to claims 5 or 8, wherein said additive is present at less than about 1 weight percent and has an average particle size of less than about 5 microns.

26. The metallurgical composition according to claim 2, wherein said binding agent has a molecular weight of less than about 400,000.

27. The metallurgical composition according to claims 26, wherein said binding agent has a molecular weight of from about 10,000–100,000.

28. The metallurgical composition according to claim 26, wherein said binding agent is a copolymer of vinyl pyrrolidone and at least about 50 percent of the monomer units comprise vinyl pyrrolidone.

29. The metallurgical composition according to claim 28, wherein at least about 70 percent of the monomer units comprise vinyl pyrrolidone.

30. The metallurgical composition according to claim 29, wherein said copolymer is a copolymer of vinyl pyrrolidone and vinyl acetate.

31. The metallurgical composition according to claim 2, wherein said binding agent is a homopolymer.

32. The metallurgical composition according to claim 31, wherein said binding agent has a molecular weight of less than about 400,000.

33. The metallurgical composition according to claim 32, wherein said binding agent has a molecular weight of from about 10,000–100,000.

34. The metallurgical composition according to any of claims 26, 27, 32 or 33, wherein said copolymer is water-soluble.

* * * * *

UNITED STATES PATENT AND TRADEMARK OFFICE

CERTIFICATE OF CORRECTION

PATENT NO. : 5,069,714

DATED : December 3, 1991

INVENTOR(S) : FRANCIS GOSSELIN

It is certified that error appears in the above-identified patent and that said Letters Patent is hereby corrected as shown below:

IN [56] REFERENCES CITED

Under U.S. PATENT DOCUMENTS, insert:

| | | | | |
|---|---|---|---|---|
| -- | 2,888,738 | 6/1959 | Taylor | 29/182 |
| | 3,451,809 | 6/1969 | Raman et al. | 75/205 |
| | 3,846,126 | 11/1974 | Foley et al. | 75/211 |
| | 3,988,524 | 10/1976 | Dreyer et al. | 428/403 |
| | 4,062,678 | 12/1977 | Dreyer et al. | 75/228 |
| | 4,106,932 | 8/1978 | Blanchford | 75/252 |
| | 4,483,905 | 11/1984 | Engstrom | 428/570 |
| | 4,504,441 | 3/1985 | Kuyper | 419/35 |
| | 4,566,905 | 1/1986 | Akashi et al. | 75/244 --. |

Under FOREIGN PATENT DOCUMENTS, insert:

| | | | |
|---|---|---|---|
| -- | 206401 | 8/1988 | Japan . |
| | 01230 | 1985 | PCT Int'l Appl. . |
| | 0264287 | 4/1988 | European Pat. Appl. . |
| | 0266936 | 5/1988 | European Pat. Appl. . --. |

Insert: -- OTHER PUBLICATIONS

J. Tengzelius, et al., "Influence on Precision of PM Parts of Various Binder Additions to Powder", Power Metallurgy (1985) Vol. 28, No. 1; H.C. Messman, "Binders for Briquetting and Agglomeration", Proceedings of the 15th Biennial Conference. --.

COLUMN 1

Line 58, "gluer, et al." should read --glu, et al.--.

UNITED STATES PATENT AND TRADEMARK OFFICE

CERTIFICATE OF CORRECTION

PATENT NO. : 5,069,714

DATED : December 3, 1991

INVENTOR(S) : FRANCIS GOSSELIN

It is certified that error appears in the above-identified patent and that said Letters Patent is hereby corrected as shown below:

COLUMN 3

Line 52, "and" should read --or--.

COLUMN 8

Line 8, "1½" should read --1-1½--.

COLUMN 10

Line 65, "claims 26," should read --claim 26,--.

Signed and Sealed this

Third Day of August, 1993

Michael K. Kirk

MICHAEL K. KIRK

*Acting Commissioner of Patents and Trademarks*

*Attest:*

*Attesting Officer*